United States Patent [19]

Harrison et al.

[11] 4,147,441

[45] Apr. 3, 1979

[54] UNDERARM DEODORANT APPLICATOR

[75] Inventors: Thomas S. Harrison, New Canaan, Conn.; Ross L. Doyle, Ramsey, N.J.

[73] Assignee: Sterling Drug, Inc., New York, N.Y.

[21] Appl. No.: 759,827

[22] Filed: Jan. 17, 1977

[51] Int. Cl.[2] ..... B05C 17/00

[52] U.S. Cl. ..... 401/208

[58] Field of Search ..... 401/208, 21, 218, 191, 401/219, 118, 48, 292; 15/104.93; 239/34.36

[56] References Cited

U.S. PATENT DOCUMENTS

| | | | |
|---|---|---|---|
| 2,057,085 | 10/1936 | Danco | 401/208 |
| 3,441,353 | 4/1969 | Claff | 401/208 X |
| 3,775,801 | 12/1973 | Walker | 15/104.93 |

*Primary Examiner*—Stephen C. Pellegrino
*Attorney, Agent, or Firm*—Charles R. Fay

[57] ABSTRACT

A deodorant applicator comprising a hand held and manipulated container having an open top, an elongated impregnated web therein, an element closing the container and forming a working head for exposing and supporting the web step by step across its surface for application of the deodorant, the web being led out of the container at its leading end and severed, sheet by sheet, after use.

15 Claims, 5 Drawing Figures

UNDERARM DEODORANT APPLICATOR

BACKGROUND OF THE INVENTION

There are many deodorant applicators that spray, roll on, but these are wet and there are few dry applicators. It is the object of this invention to provide an easily actuated simply constructed dry deodorant applicator.

SUMMARY OF THE INVENTION

A web of paper or paper-like material, e.g. nonwoven fabric, is impregnated with powder, antiperspirant and deodorant ingredients and placed in a box with an open top substantially closed by a working head having a convex or semi-cylindrical surface over which the web is pulled by the user, step by step, after use. Means is provided to sever each used portion of the web, this means being in the nature of a constraining edge or bar holding the impregnated material in place as the user applies the deodorant by a back and forth movement, holding the container as a handle.

PREFERRED EMBODIMENT OF THE INVENTION

Figure 1:
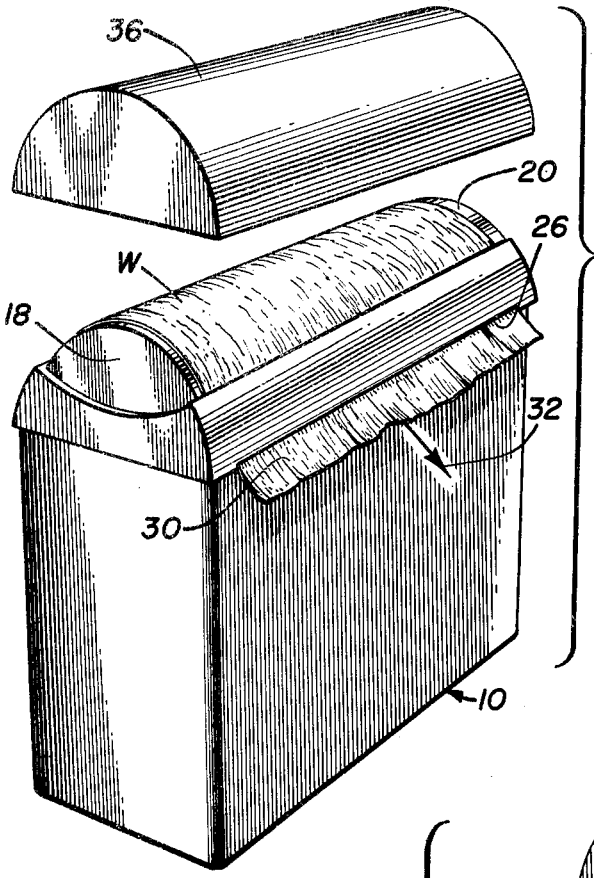
FIG. 1 is a perspective view of the applicator with the cover removed and ready for use.
Figure 2:
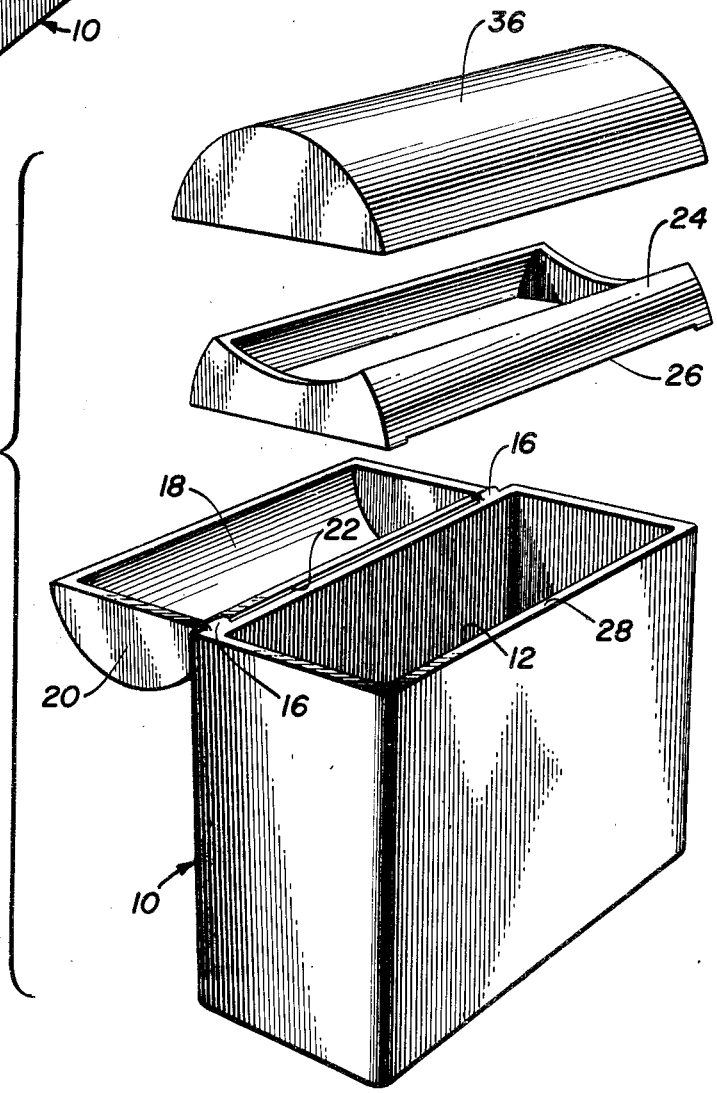
FIG. 2 is an exploded view of the applicator with web removed.

FIGS. 1 and 2 illustrate a box or other container 10 having a closed bottom, side and end walls, and an open top 12. This box is preferably impervious, and contains a web of wet or dry impregnated paper, fabric, etc. The web may be in the form of a roll, stacked interleaved sheets, or folded, pleated, etc., so that it may be withdrawn from the container one step or sheet at a time. The web may be perforated or not.

Hinged at 16, along an edge of the container, is a semi-cylindrical surfaced element 18 having a curved, stationary exterior working surface 20 over which the web passes issuing from a slot 22, from the interior of the container. This slot forms a vapor seal for the container to prevent liquid or vapor from escaping, when the element 18 is closed. The web is threaded up through the slot 22 and over the working surface 20.

An open rectangular fitment generally indicated at 24, open top and bottom, and conforming to the shape of the working surface 20, is fitted to the top of the container over the working surface leaving the web exposed. The front edge at 26 of the fitment however leaves a slot between itself and the front top edge 28 of the container for the passage of the web as shown at 30 where the leading edge of the web may be grasped by the fingers of the user and drawn out in the direction as shown by the arrow 32. This slot also serves as a vapor seal. A cover 36 may be used to snap down over the exposed web, preventing vaporization when the dispenser is not in use.

In operation the user removes the cover 36, exposing the first part of the web ready for use. The deodorant is applied with a back and forth movement and the formula, dry or moist, is transferred to the underarm or other parts of the body. There is enough deodorant material to do both armpits, for example, and then the sheet is pulled down and torn off along edge 26 bringing up a new sheet on the working surface. The exposed web can be finger pushed to bring down a leading tab as disclosed in the drawings, for easy grasping, pulling and tearing off.

Figure 3:
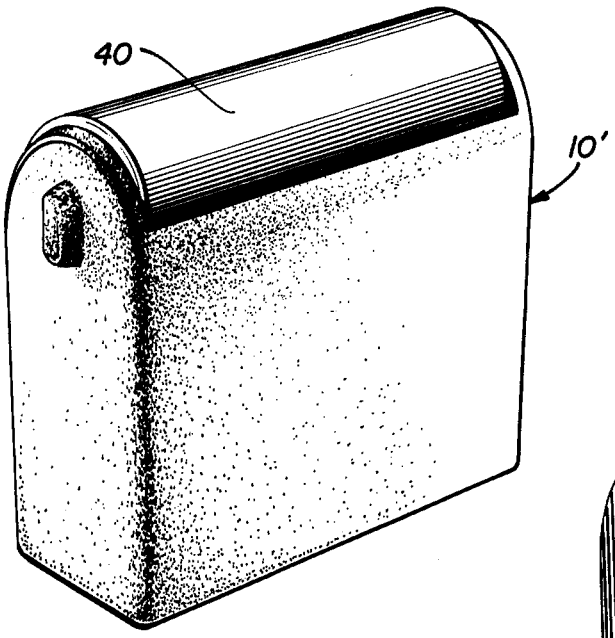
FIG. 3 illustrates a roller applicator head.
Figure 4:
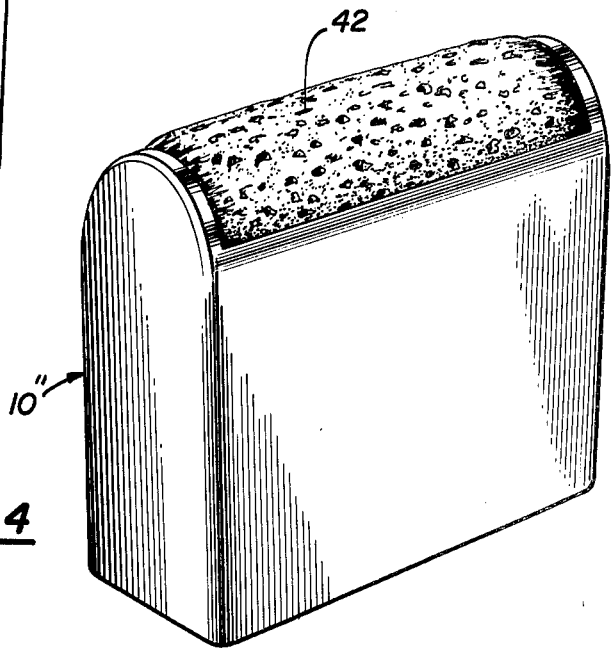
FIG. 4 illustrates a sponge type applicator head.

Instead of using a stationary working surface, a roller 40 can be journalled in the end walls of container 10', FIG. 3 or a fixed shaped sponge head 42 can be utilized, FIG. 4.

Figure 5:
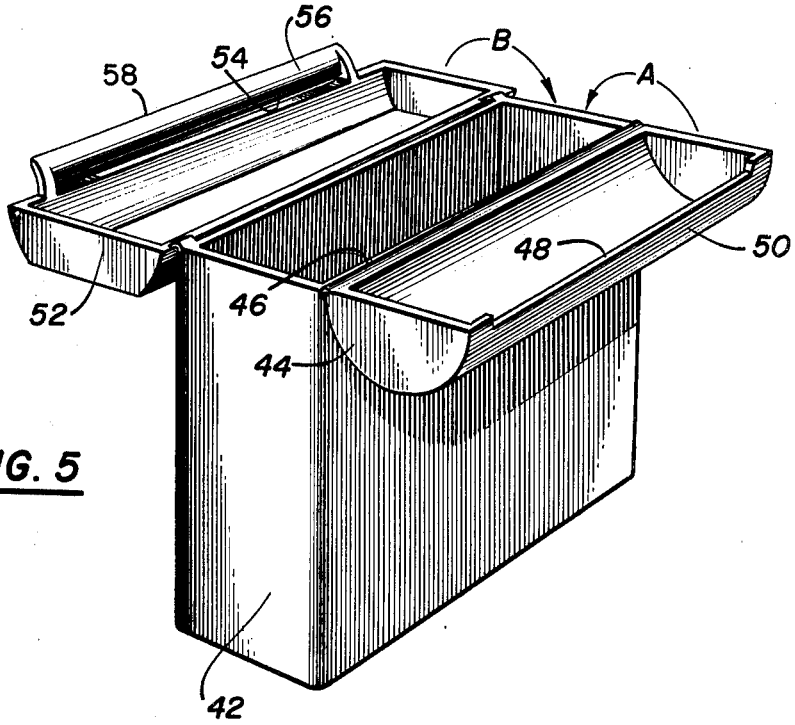
FIG. 5 is a perspective view illustrating a modification with the parts open to show the construction.

A modification is shown in FIG. 5 wherein the container 42 is similar to that at 10 but in this case the semi-cylindrical working element 44 is pivoted along the front edge 46 of the container for disposition over the open top thereof as in FIG. 1. An elongated edge notch 48 forms a vapor seal slot for the passage of the web from the container and over the curved working surface 50 of the element 44 when the latter is down in the closed position of the container, as in FIG. 1. The fitment may be separate as in FIG. 2 but it is shown in FIG. 5 as an integral hinged member as is the element 44, in which case the container may be conveniently made in one piece, with the element 44 swingable over the container, arrow A, and the fitment 52 reversely swingable over all, arrow B. A cover similar to that at 36 may be utilized, and all the movable parts snap into place. The fitment 52 has a vapor seal slot 54 for the web, and in FIG. 5 is shown provided with a tear-off bar 56 with the tear-off edge at 58.

This tear-off bar extends outwards from the wall of the container when down in place over the element 44, and where the user pulls up on the web to sever it, a leading pull tab of web is left between the tear-off bar and the adjacent container wall for grasping between the user's fingers to advance the next sheet of the web over the working surface of the element 18 or 44.

We claim:

1. An applicator for material to the body comprising a hand held container, a web of impregnated material therein, said web having a leading end adapted to be grasped and pulled out from the container, an exit opening in the container for the web, means forming a working surface on the container, means to guide the web over the working surface as it is pulled out, the user utilizing the container as a handle in applying the web on the working surface to the body, and means to sever the used part of the web, the severing means holding the portion of the web to the working surface during utilization of the applicator.

2. The applicator of claim 1 wherein the severing means comprises a member having an edge overlying the web as it is extracted past the working surface, the latter being located between the severing means and the exit opening.

3. The applicator of claim 2 wherein the member having the severing edge is separate from the container.

4. The applicator of claim 3 wherein said member comprises an open frame superposed on the means forming the working surface.

5. The applicator of claim 2 wherein the means forming the working surface comprises a member hinged along a side of the open top of the container.

6. The applicator of claim 5 wherein the member having the severing edge is hinged along the opposite side of the open top of the container.

7. The applicator of claim 6 wherein the member having the working surface is adapted to underlie the member having the severing edge.

8. The applicator of claim 1 wherein the working surface is convex.

9. The applicator of claim 1 wherein the working surface is semi-cylindrical.

10. The applicator of claim 1 wherein the working surface is a roller.

11. The applicator of claim 1 wherein the working surface is a sponge.

12. The applicator of claim 1 wherein the working surface is a sponge having a convex surface.

13. The applicator of claim 1 wherein the container has an open top normally closed by the means forming the working surface, the latter being movable giving access to the container.

14. The applicator of claim 1 wherein the means forming the working surface is hinged to the container adjacent the open top thereof.

15. The applicator of claim 14 wherein the exit opening is located along the hinge axis of the means forming the working surface.

* * * * *